US007297091B2

(12) United States Patent
Nushart

(10) Patent No.: US 7,297,091 B2
(45) Date of Patent: Nov. 20, 2007

(54) METHOD AND APPARATUS FOR ANTERIOR AND POSTERIOR MOBILIZATION OF THE HUMAN ANKLE

(76) Inventor: Michael J. Nushart, 4390 E. Dome Rd., Prescott, AZ (US) 86305

( * ) Notice: Subject to any disclaimer, the term of this patent is extended or adjusted under 35 U.S.C. 154(b) by 327 days.

(21) Appl. No.: 11/207,261

(22) Filed: Aug. 19, 2005

(65) Prior Publication Data

US 2006/0058719 A1 Mar. 16, 2006

Related U.S. Application Data

(60) Provisional application No. 60/610,479, filed on Sep. 15, 2004.

(51) Int. Cl.
*A63B 23/08* (2006.01)
*A63B 21/02* (2006.01)

(52) U.S. Cl. ..... 482/79; 482/80; 482/91; 482/92; 482/131; 482/907; 602/27

(58) Field of Classification Search ..... 482/79, 482/80, 91, 92, 122, 123, 124, 125, 126, 482/129, 130, 145, 905, 907; 273/451, 452; 601/27, 29, 33; 602/27, 28, 29; *A63B 69/06, A63B 21/02, 23/08*

See application file for complete search history.

(56) References Cited

U.S. PATENT DOCUMENTS 4,306,714 A * 12/1981 Loomis et al. ..... 482/79
4,432,543 A * 2/1984 Normandin ..... 482/131
4,573,678 A * 3/1986 Lamb et al. ..... 482/80
5,035,421 A * 7/1991 Scheller ..... 482/79
5,277,680 A * 1/1994 Johnston ..... 482/95
5,611,770 A * 3/1997 Tesch ..... 601/34
5,645,516 A * 7/1997 Foster ..... 482/79
6,206,807 B1 * 3/2001 Cowans et al. ..... 482/79
6,589,141 B1 * 7/2003 Flaggs ..... 482/79
6,709,369 B1 * 3/2004 Jacobs ..... 482/80
6,821,235 B1 * 11/2004 Johnson et al. ..... 482/79
6,935,991 B1 * 8/2005 Mangino ..... 482/51
2007/0161480 A1 * 7/2007 Trancart et al. ..... 482/907

* cited by examiner

*Primary Examiner*—Kimberly S. Smith
*Assistant Examiner*—Oren I Ginsberg
(74) *Attorney, Agent, or Firm*—Owen L. Lamb

(57) ABSTRACT

An apparatus for anterior and posterior mobilization of the human talocrural joints for rehabilitation and/or therapeutic utilization. A patient's foot is secured in an apparatus and an Ankle Mortise Strap is looped around the mortise of an ankle of the foot. A force strap is attached to the ends of the Ankle Ankle Mortise Strap. Anterior mobilization is achieved by moving the force strap ventrally from the foot so that the foot including the talus remains stationary while the tibia and fibula glide anteriorly. Posterior mobilizations are achieved by securing the foot, and looping an Ankle Mortise Strap around the front of the ankle. A force strap is attached to the ends of the Ankle Mortise Strap. Posterior mobilization is achieved by moving the force strap dorsally from the foot so that the foot including the talus remains stationary while the tibia and fibula glide posteriorly.

16 Claims, 5 Drawing Sheets

METHOD AND APPARATUS FOR ANTERIOR AND POSTERIOR MOBILIZATION OF THE HUMAN ANKLE

I hereby claim the benefit under 35 U. S. C. Section 119(e) of United States Provisional application 60/610,479 filed Sep. 15, 2004.

BACKGROUND OF THE INVENTION

1. Field of the Invention

The invention relates generally to the field of physical therapy methods and apparatus to prepare an injured ankle joint for the strengthening process inherent in physical medicine and rehabilitation by reducing pain and stiffness, while increasing flexibility and range of motion.

2. Description of the Prior Art

U.S. Pat. No. 4,306,714 to Loomis, et al. filed Dec. 22, 1981 "Iso-energetic Ankle Exerciser" discloses an exercise device for the hands or feet in which the user supplies the force and motion by one hand or foot which will be countered by a resistance and similar motion of the other hand or foot.

This instrument rotates in three axes and is capable of being restrained from movement in each axis independently. The possible movement is therefore about any one of the three axes with the two other axes locked, any combination of two axes with the remaining axis locked, or rotation about all three axes with no rotational locks in place.

The rotational movement about any given axis of one foot is duplicated with an equal rotation about the same axis by the other foot. Rotation in three dimensions about either the X, Y or Z-axis or any combination thereof is possible.

Rotation about the Z-axis provides flexibility and strength training of the appropriate muscle group. Rotation about the X-axis provides flexibility and strength of the Dorsi-Flexor and extensor muscles of the foot and ankle. Rotation about the Y-axis provides flexibility and strength of the lateral (inversion and eversion) muscle groups. Each foot is secured to an individual platform, which assures that the desired foot movement and muscle involvement is obtained. The multiple axis unit is designed to exercise the lower leg, ankle and foot via reciprocal resistance, controlled by the individual using the unit The unit allows rotation of the foot about three axes to enhance both training and rehabilitation. This exercise unit will improve flexibility and range of motion in the lower leg, ankle and foot. In addition, the general strength of the muscles of the lower leg which support the ankle will be increased through isolated contralateral resistance movements.

U.S. Pat. No. 4,432,543 to Normandin, filed Feb. 21, 1984 "Physiotherapeutic Self-exerciser" discloses a physiotherapeutic self-exerciser which enables a patient to apply traction to the muscles or tendons of the feet whereby the patient may exert the necessary tension which is required to exercise a tendon or muscle to be treated. The exerciser includes a sabot (similar to a sandal or shoe having a band of leather or other material across the instep) to which the patient's foot is attached and a pair of levers which are manually engageable by the patient. The patient gradually applies weight to the levers connected to the sabot, thereby exerting an upward tension of the sabot, and the latter, combined with the flexing of the patient's knee, exerts a predetermined traction on the tendon or muscle to be treated.

The foot is solidly tied to the sabot, which pivots around an axis associated with a base. On an appropriate support affixed to this base, a system of levers is articulated and tied to a pre-determined point of the sabot structure. While flexing the knee, the patient gradually applies weight to the lever system, which exerts an important upward tension on the sabot. The tension, combined with the flexing of the knee, exerts the required traction on the affected tendon.

U.S. Pat. No. 5,879,272 to Mekjian, filed Mar. 9, 1999, "Adjustable Physical Therapy Apparatus" discloses an apparatus consisting of a support base on which is mounted a horizontally oriented bounding platform assembly support bar so as to be vertically adjustable with respect thereto. The bounding platform assembly consists of two pivotally connected bounding platforms, which are selectively draped over the support bar so that the free ends thereof rest upon the floor. The angle of inclination of the pivotally connected bounding platforms is selectively variable by vertically adjusting the support bar with respect to the support base so as to provide bounding surfaces for vigorous lateral rehabilitation exercises by the patient. The two adjustable physical therapy units are attached in an end-to-end relationship so as to provide adjacent bounding platforms with a reverse angle of inclination so as to provide bounding surfaces for vigorous medial rehabilitation exercises by the patient. The apparatus is specifically adaptable for selective rehabilitation exercises by a patient to improve the strength and stability of injured joints in the lower body extremities, i.e. the ankles, knees and hips. The opposed, inclined platforms enable the patient to perform selective bilateral bounding activity on the inclined platforms by pushing off with one leg from one inclined platform and landing with the other leg on the opposite inclined platform. This results in beneficial rehabilitating stress along the lateral aspects of the joints as the bounding activity is repeated with resultant increased strength in the injured joint.

The above and numerous other patented exercise devices, are intended for strengthening the lower leg muscles that control the ankle joint.

What is needed, and not provided by the prior art, is an apparatus and method of use that will prepare a previously injured ankle joint for the strengthening exercises inherent in the physical medicine/rehabilitation process by reducing pain and stiffness and increasing flexibility and range of motion.

Ankle sprains and fractures with soft-tissue and osseous, respectively, damage, are common injuries, especially among active individuals and athletes. The treatment of ankle soft tissue injury typically involves control of pain and swelling, and increasing range of motion in preparation for resistive, strengthening exercises. Routines that include early mobilization (passive oscillatory movement applied at a joint to increase accessory movement or to modulate pain.) and stretching of musculotendinous tissues have led to early return to activities.

Existing treatment involves manual mobilization techniques, which, although generally effective, lack replicability from one patient to the next and, from one physical therapy practitioner to the next The force of manual mobilization also is difficult to quantify. The stretching of musculotendinous ligamentous and joint capsular tissues is a basic need to enable users to duplicate mobilizations and quantify forces applied.

The talocrural (ankle) joint consists of the articulation between the trochlea of the talus and the mortise which includes the medial malleolus of the tibia, the lateral malleolus of the fibula and the distal articulating surface. The talocrural joint allows plantarflexion (downward pointing) and dorsiflexion (raising) of the foot. It is generally accepted that during ankle dorsiflexion, the talus rolls and glides posteriorly in relation to the mortise. These accessory motions of glide are frequently impaired as a result of an ankle injury resulting in dysfunction of movement.

This dysfunction can manifest itself in hypermobility, an increase in the range of movement of which a bodily part and especially a joint is capable or, hypomobility, the decrease in the normal range of joint movement, often characterized by the loss of accessory movements. Accessory movements are defined as joint movements that cannot be performed voluntarily or in isolation by the patient. Glide and roll of the talus in the mortise are considered accessory movements. Studies have shown significant improvements in dorsiflexion range of motion and restoration of normal gait patterns after anterior to posterior mobilizations of talocrural and proximal tibiofibular joints. See: Dananberg, H. J., Shearstone, J., & Guillano, M. (2000). Manipulation method for the treatment of ankle equinus *J Am Podiatric Med Assoc* 90, 385389 PubMed Full Text and Denegar, C. R., Hertel, J., & Fonseca, J. (2002). The effect of lateral ankle sprain on dorsiflexion range of motion, posterior talar glide, and joint laxity *J Orthop Sports Phys Ther* 32, 166173 PubMed.

The existing treatment method consists of passive manual mobilization of the ankle joint by the physical therapy practitioner. This practice, although generally effective, is subject to inconsistent results due to essential variables in its application. Differences in physical stature and strength from one physical therapy practitioner to the next greatly affect the efficacy of the procedure.

Differences in facilities such as table height and construction will also change the results of the mobilization procedure as the body position and, associated leverage, of physical therapy practitioner changes with the facilities.

Typically, passive manual mobilization techniques do not allow active movement of the joint, particularly dorsiflexion that is beneficial during mobilization.

Communication between the physical therapy practitioner and the patient regarding pain intensity is critical in the prior art method. Certain more aggressive mobilization techniques run the risk of shock loading the patient's ankle joint, i.e. applying the force too quickly and/or forcefully. The slightest delay in communicating pain can result in undesired results such as increased and prolonged pain and delayed recuperation.

During early stages of rehabilitation, patients can experience frequent intense pain. Physical therapy in general and, more specifically, mobilization reduces the intensity and frequency of the pain. Unfortunately physical therapy appointments are not daily events resulting in the patient having to endure pain on days without appointments. It is not possible to perform manual mobilization of the ankle joint on oneself.

It is therefore desirable to provide an apparatus that can be used in rehabilitation and physical therapy of the human ankle. The primary purpose is to increase the flexibility of the tendons, ligaments and joint capsule in the ankle through stretching and mobilization of the talocrural joint at the ankle mortise of the talus It is desirable to provide a method and apparatus, which solves these problems. The apparatus, first and foremost, should allow for repeatability of ankle mobilization from one physical therapy practitioner to the next, one mobilization to the next and, one patient to the next.

It is desirable to provide a method and apparatus, which allows mobilizations on patients in the seated or standing position.

It is desirable to provide a method and apparatus, which allows the patient to apply force, and the resulting glide, to himself or herself. This enables maximum force and glide, without pain because the patient judges the pain intensity for himself or herself eliminating the possibility of increased and prolonged pain and delayed recuperation.

It is desirable to provide a method and apparatus, which after several supervised mobilization sessions, the physical therapy practitioner can specify the apparatus settings for the next session and the patient can be easily taught to perform the mobilizations, unassisted. This leads to the next, logical, step i.e. allowing a patient to take an apparatus home and perform mobilizations on himself or herself. It is therefore desirable that the apparatus be small and light enough to be easily transported by the patient.

It is desirable to provide a mobilization apparatus, which allows the patient to apply the treatment; thus freeing all those involved in the treatment from a very time-consuming task.

SUMMARY OF THE INVENTION

Briefly, the invention is concerned with an apparatus and methodology for anterior and posterior mobilization of the ankle. A patient's foot is secured in the apparatus and an Ankle Mortise Strap is looped around the back of the ankle mortise. A force strap is attached to the ends of the Ankle Mortise Strap. Anterior mobilization is achieved by moving the force strap ventrally from the foot so that the foot, including the talus remains stationary while the tibia and fibula glide anteriorly. Posterior mobilizations are achieved by securing the foot, and looping an Ankle Mortise Strap around the front of the ankle. A force strap is attached to the ends of the Ankle Mortise Strap. Posterior mobilization is achieved by moving the force strap dorsally from the foot so that the foot including the talus remains stationary while the tibia and fibula glide posteriorly.

The apparatus, most effectively used in the standing position, stretches and mobilizes the talocrural joint in the functional (closed chain) position. This closed pack position produces talocrural joint approximation, which stimulates joint mechanoreceptors to provide afferent feedback to the spinal cord and brain resulting in learned motor movement.

In accordance with an aspect of the invention the method of anterior mobilizations comprises steps of:

securing a foot by placing a foot strap section across the dorsum of the foot so that the top edge is at, or slightly below, the head of the talus of the foot positioned such that the strap lays flat, in full contact, on the dorsum of the foot;

looping an Ankle Mortise Strap around the back of an ankle of the foot with a horizontal centerline approximately at or slightly above the medial and lateral malleolus; attaching a force strap to the ends of the Ankle Mortise Strap; and, achieving anterior mobilization by moving the force strap ventrally from the foot so that the foot including the talus remains stationary while the tibia and fibula glide anteriorly.

In accordance with another aspect of the invention, posterior mobilizations are achieved by a method comprising steps of:

securing a foot by placing a heel cup strap and stirrup on the heel of the foot so that a horizontal centerline of the heel cup strap coincides with the horizontal centerline of the patient's calcaneous;

looping an Ankle Mortise Strap around the front of an ankle of the foot with a horizontal centerline approximately at the center or slightly above the medial and lateral malleolus; attaching a force strap to the ends of the Ankle Mortise Strap; and, achieving posterior mobilization by moving the force strap dorsally from the foot so that the foot including the talus, remains stationary while the tibia and fibula glide posteriorly.

The invention has the advantage that it enables both anterior and posterior passive mobilization of the talocrural joint while allowing for active movement of the talocrural joint in the functional closed chain position.

The invention has the advantage that it allows for up to 15° dorsiflexion of the talocrural joint during mobilization.

The invention has the advantage that it provides repeatability in mobilization practice by eliminating variabilities in mobilization force of application due to differences in physical stature or strength between physical therapy practitioners.

The invention has the advantage that it allows one to perform mobilizations on oneself after receiving guidance from a physical therapy practitioner.

The invention has the advantage that the unit is lightweight and small enough to be transported easily allowing patients to use it at home between physical therapy sessions at a physical therapy clinic.

The invention has the advantage that the method and apparatus provides an array of straps which allow the joint mobilization to begin with light straps early in the physical therapy rehabilitation process with progress to heavier straps as determined by the physical therapy practitioner. Shortly after injury the mobilization begins with light straps with the tensile value of straps increased as patient's pain from the injury/surgery decreases and range of motion and strength is gained.

The invention has the advantage that an adjustment feature of a hook anchor allows the height to be changed. As the distance between the hook anchor, and a force lever pivot point (cross pin) change, so does angle of pull. This allows the physical therapy practitioner to precisely achieve the direction and amount of glide desired. Also, the ratio of travel changes when comparing the distance traveled at the top of the lever to the distance traveled at the hook anchor point. This allows the physical therapy practitioner to tailor the force applied to the ankle joint based on the individual patient's progress.

The invention has the advantage that graduated indicator marks on the force lever, a measuring tape affixed to the baseplate alongside each anchor track and footplate elevation device markings that indicate the elevation angle, all allow repeatability of settings.

The invention has the advantage that the foot strap is secured to the footplate by two pivoting strap anchors and this pivoting action enables achievement of the appropriate angle between the plane of the footplate and the plane of the strap. This allows precise placement of the strap at the head of the talus.

The invention has the advantage that since the two parts of a stirrup strap are attached to a heel cup strap with hook and loop material as well as connected to each other with hook and loop, a wide range of adjustability is achieved. The stirrup strap ensures that the heel cup strap doesn't 'ride up' above the patient's heel and impinge on the Achilles tendon.

The invention is next described further in connection with preferred embodiments, and it will become apparent that various additions, subtractions, and modifications can be made by those skilled in the art without departing from the scope of the invention.

BRIEF DESCRIPTION OF THE EMBODIMENTS

A more complete understanding of the invention may be obtained by reference to the drawings, in which.

DETAILED DESCRIPTION OF THE INVENTION

Figure 1:
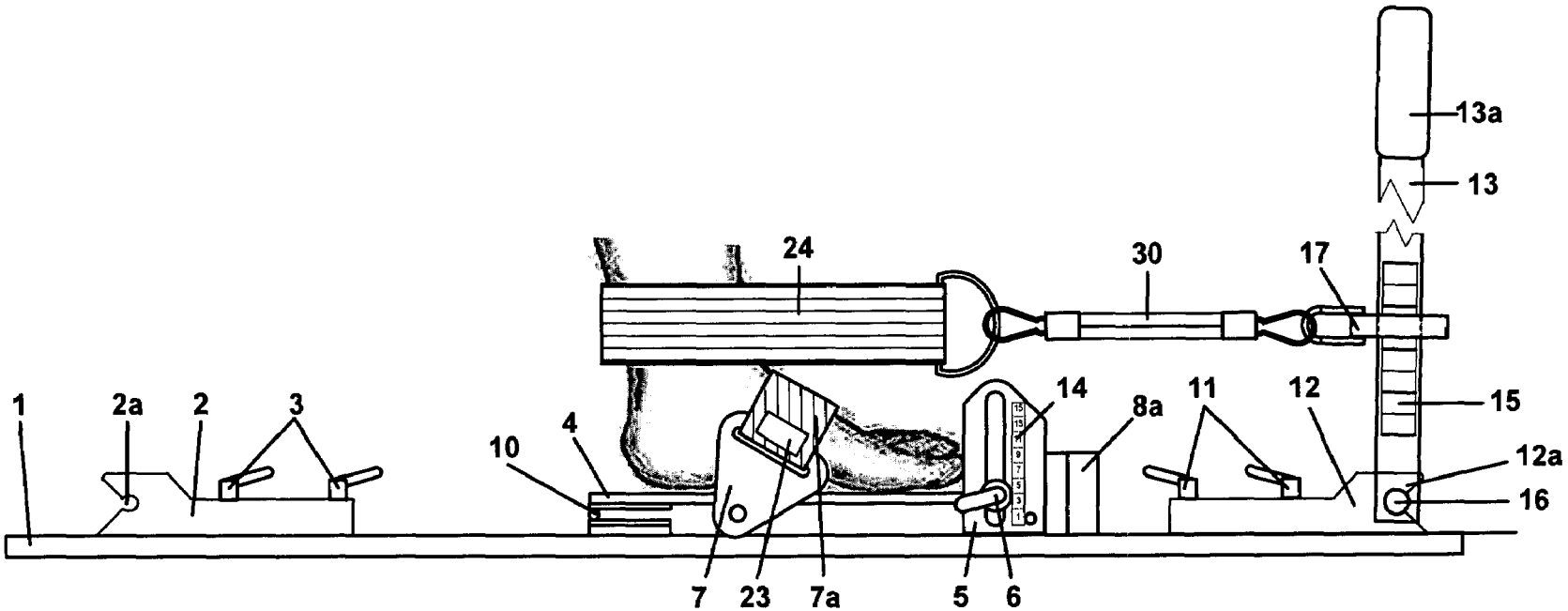
FIG. 1 is an elevation view of the present invention in the anterior mobilization configuration, with the Ankle Mortise Strap, force strap and, force lever installed.
Figure 2:
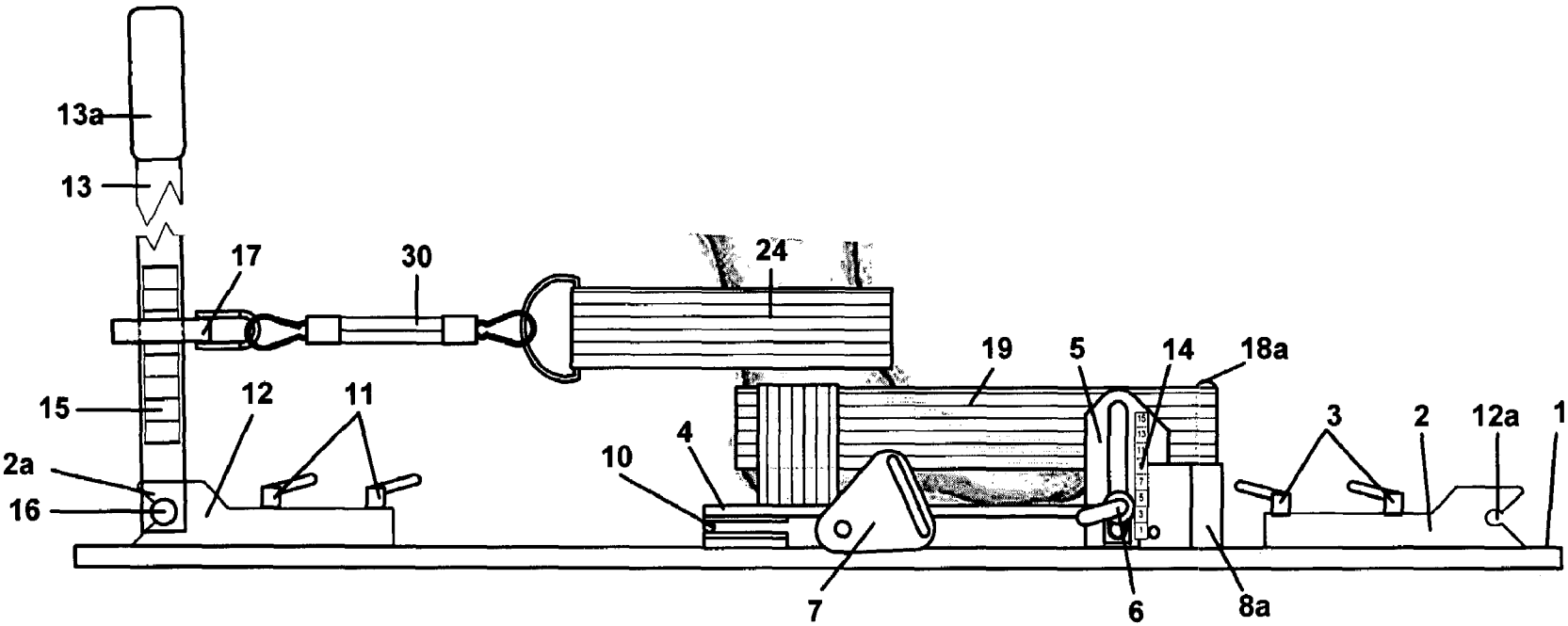
FIG. 2 is an elevation view of the apparatus of FIG. 1 in the posterior mobilization configuration, with heel cup, Ankle Mortise Strap, force strap and, force lever installed.
Figure 3:
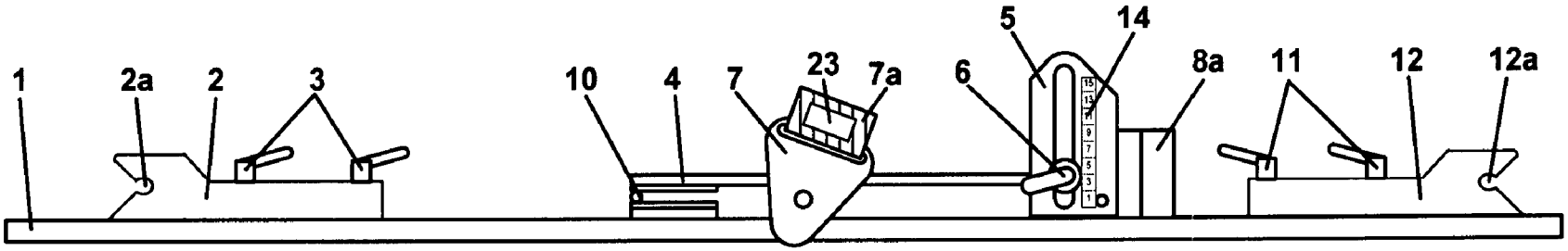
FIG. 3 is an elevation view of the apparatus of FIG. 1 with the footplate in the horizontal position.
Figure 4:
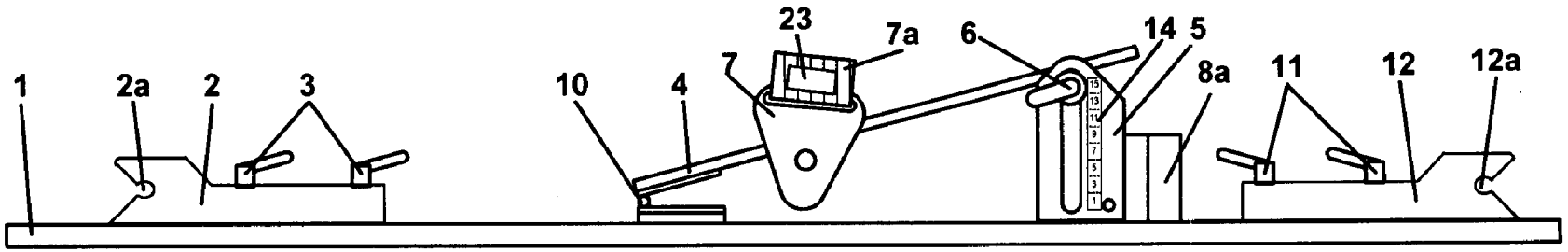
FIG. 4 is an elevation view of the apparatus of FIG. 1 with the footplate elevated to a maximum angle.

Refer to the FIG. 1, which is an elevation view of the apparatus of the present invention during anterior mobilization of the ankle and FIG. 2, which is an elevation view of the apparatus shown in FIG. 1 during posterior mobilization of the ankle; The apparatus consists of a baseplate 1 to which is attached a footplate 4 and a front anchor track 12 and a rear anchor track 2. The lengthwise centerlines of the anchor tracks 2, 12 are coincidental with the lengthwise centerlines of the footplate 4 and baseplate 1.

The footplate is hinged by a hinge 10 at one end and employs an elevation device 5 at the opposite end allowing that end to be raised to and locked at any degree of dorsiflexion to a maximum of fifteen degrees (15°) above horizontal. Locking is achieved through the use of integral adjustable clamping levers 6. The elevation device is marked 14 to indicate the dorsiflexion angle. The footplate also includes an adjustable, pivoting foot strap 7*a*. The foot strap is secured to the footplate by two pivoting strap anchors 7. Adjustment of the length and corresponding tightness is accomplished with hook and loop material 23 affixed to the strap 7*a*.

Figure 5:
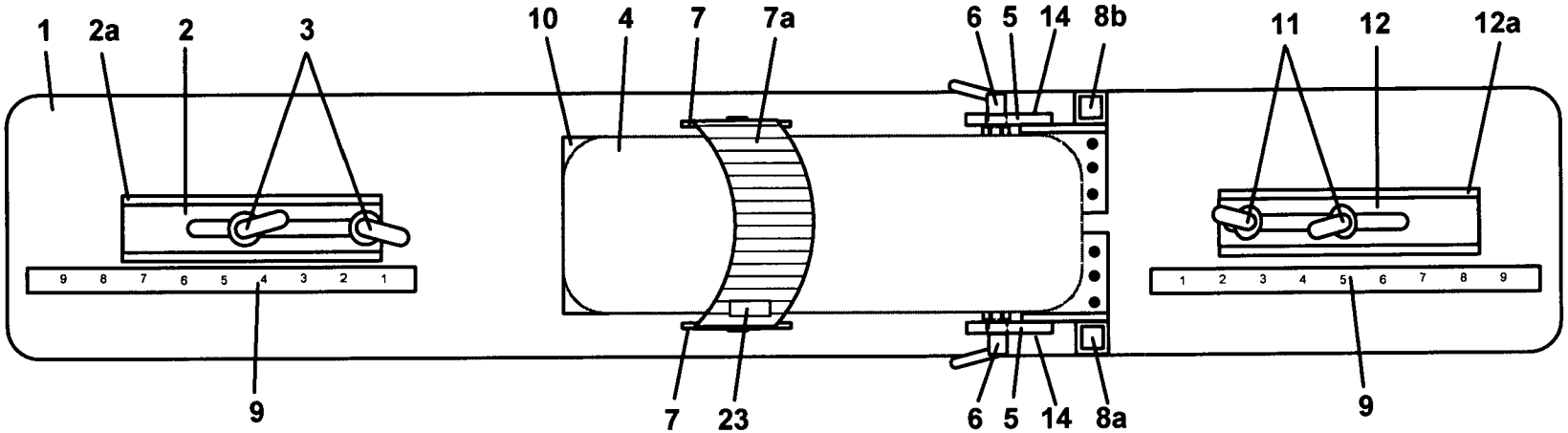
FIG. 5 is a plan view of the apparatus shown in FIG. 1.

The anchor tracks 2, 12 are each adjustable fore and aft and are locked in their desired locations with adjustable front clamping levers 11 and rear clamping levers 3. A front measuring tape 9 (FIG. 5) is affixed to the baseplate alongside the front anchor track. A rear measuring tape 9 (FIG. 5) is affixed to the baseplate alongside the rear anchor track. A front yoke, 12*a* is machined into the far end of the front anchor track to accept a force lever 13 with cross pin 16, shown in FIG. 6. A rear yoke 2*a* is machined into the far end of the rear anchor track to accept the force lever 13 with cross pin 16, shown in FIG. 6.

Figure 6:
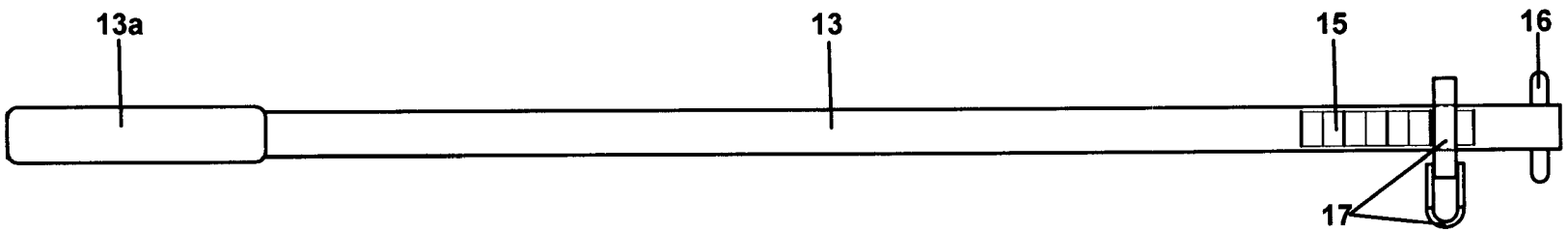
FIG. 6 is a view of the force lever with hook anchor point of the apparatus shown in FIG. 1.

Refer to FIG. 6, which is a view of the force lever with hook anchor point of the apparatus shown in FIG. 1. The force lever 13 is a long, tubular lever with a captive cross pin 16 near the bottom and a rubberized handle grip 13*a* at the top. The cross pin 16 engages the yoke 2*a* or 12*a* at the end of the front anchor track 12 or the rear anchor track 2, shown in FIG. 5. The force lever 13 also incorporates an adjustable hook anchor point 17 near the cross pin 16. Engraved graduated indicator marks 15 are included on the force lever adjacent to the hook anchor point 17.

Figure 10:
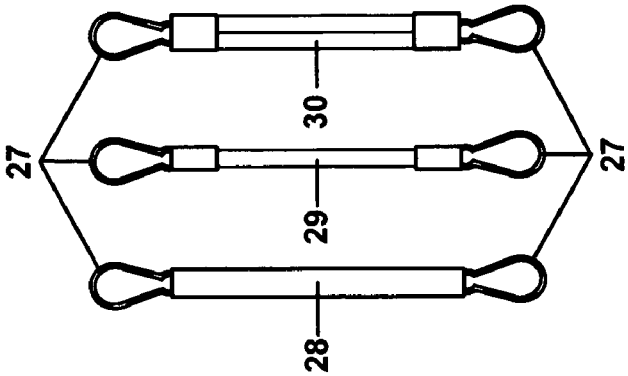
FIG. 10 is a view of the force straps.

The hook anchor point 17 accommodates a selection of elastic force straps 28, 29, 30 with varying tensile values, shown in FIG. 10. They are connected to the hook anchor point 17 of the force lever 13 with a spring snap 27.

Figure 11:
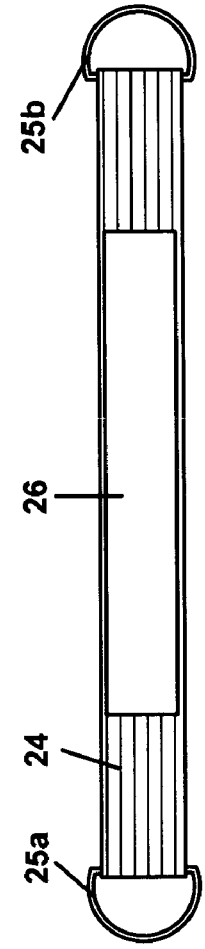
FIG. 11 is a view of the Ankle Mortise Strap.

The opposite end of the force strap(s) 28, 29, 30 attaches, also with a spring snap 27, to an Ankle Mortise Strap 24, shown in FIG. 11.

Figure 7:
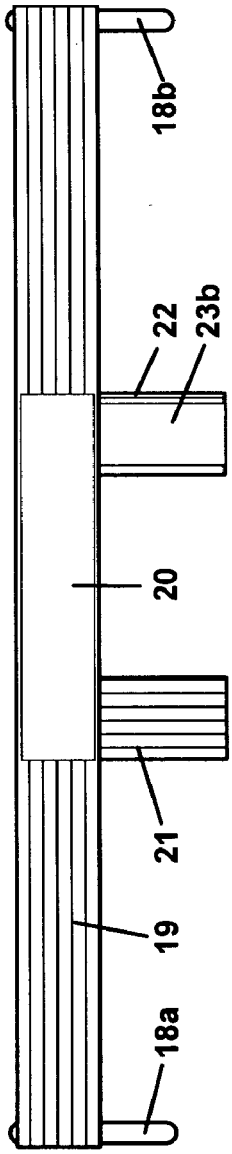
FIG. 7 is a view of the inside of the heel cup strap with anchor pins installed and stirrup strap halves disconnected.

Additionally, the apparatus has a right receiver socket 8*a* and a left receiver socket 8*b* (FIG. 5), located adjacent to the elevating end of the footplate, to accommodate left and right anchor pins 18*a* and 18*b* (FIG. 7,8) for a heel cup strap 19, shown in FIGS. 2,7.

Refer to FIG. 2, which is an elevation view of the apparatus of FIG. 1 with heel cup, Ankle Mortise Strap 24, force strap and, force lever installed. The heel cup strap 19, when installed for use, is attached to left and right anchor pins 18*a* and 18*b* inserted into the receiver sockets 8*a*, 8*b*. The heel cup strap 19 loops to the opposite, hinged, end of the footplate 4,10 and has resilient padding 20 (FIG. 7) installed inside of the loop. The heel cup strap 19 also includes a two-piece stirrup strap 21, 22 (FIG. 7) between the looped end and the anchor pins 18*a*, 18*b*. The two parts of the stirrup strap 21, 22 are attached to the heel cup strap 19 with hook and loop material as well as connected to each other with hook and loop 23*a* (FIG. 8), 23*b* (FIG. 7).

Refer to FIG. 7 which is a view of the inside of the heel cup strap with anchor pins 18*a* and 18*b* installed and stirrup strap halves 21 and 22 disconnected. The inside is fitted with padding 20 for the heel. The right half of the stirrup strap has hook and loop fastener 23*b*.

Figure 8:
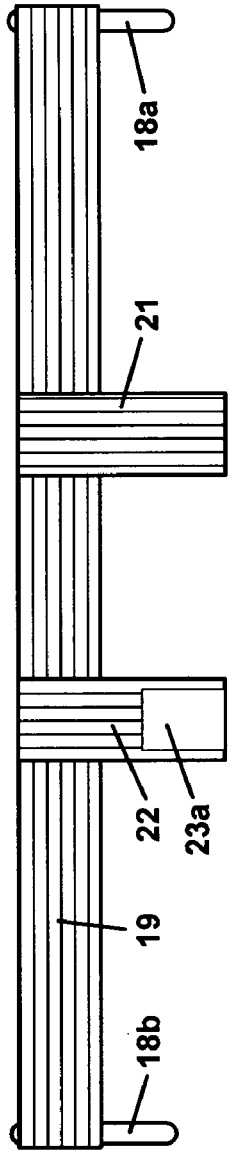
FIG. 8 is a view of the outside of the heel cup strap with anchor pins installed and stirrup strap halves disconnected.

Refer to FIG. 8, which is a view of the outside of the heel cup strap with anchor pins 18*a* and 18*b* installed and stirrup strap halves 21 and 22 disconnected. The left half of the stirrup strap has hook and loop fastener 23*a*.

Figure 9:
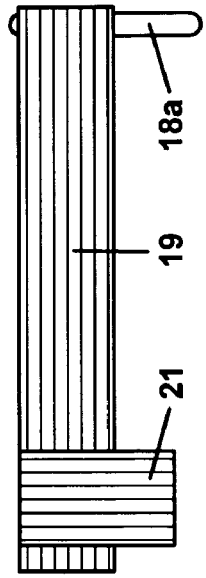
FIG. 9 is a view of the heel cup strap with anchor pins installed and stirrup strap halves connected.

Refer to FIG. 9, which is a view of the heel cup strap 19 with anchor pins 18*a* and 18*b* installed and stirrup strap halves 21 and 22 connected to form a cup to hold the bottom of the foot at the heel.

Refer to FIG. 10, which is a view of the three force straps 28, 29, and 30 that have varying tensile values. A force strap connects to the hook anchor point 17 of the force lever 13 (FIG. 6) with a spring snap 27.

Refer to FIG. 11, which is a view of the Ankle Mortise Strap 24. The Ankle Mortise Strap 24 is padded on one side, with resilient padding 26 throughout most of its length and has a D-ring 25*a* attached to one end and a D-ring 25*b* attached to the other end It is these D-rings that enable the attachment of the force strap/spring snap assembly 28, 29, 30 to the Ankle Mortise Strap 24.

DESCRIPTION OF USE AND METHOD OF OPERATION

The method of use of and operation of the apparatus are described first with reference to anterior mobilization and then with reference to posterior mobilization.

Anterior Mobilization

General

Anterior mobilizations with the apparatus can be performed with the patient in a sitting or standing position. The standing position is preferred, especially when incorporating a lunge to increase range of motion.

Set Up

The physical therapy practitioner determines the desired footplate elevation angle. The practitioner, or the patient, sets the footplate angle by loosening the two clamping levers at the sides of the footplate. The footplate can then be manually raised to the desired angle, as indicated on the elevation plates. The two footplate clamping levers are then tightened to lock the footplate at the desired angle. The clamping levers, being spring loaded, can be rotated to a position that will not interfere with the mobilization without loosening the clamping screw. They can be gently pulled away from the footplate and rotated to the desired position. The angle indication on the elevation plates allows the physical therapy practitioner to note the selected angle and record that position for future mobilizations on that patient.

Force Strap Selection

A single, elastic strap is supplied for the lightest force and least chance of shock loading applied to the ankle joint. Additionally, a tandem elastic strap is supplied for increased force, also with reduced risk of shock loading. Finally, a solid strap is supplied for maximum force and anterior glide of the mortise on the talus. This solid strap is used for patients whose progress is advanced and pain is infinitesimal or not present.

Force Strap Connection

Each of the straps is fitted with a spring snap at each end. The selected straps' spring snap is connected to the hook anchor point on the force lever. The spring snap at the opposite end of the force strap is attached to the D-rings of the Ankle Mortise Strap in a subsequent step.

Foot Placement and Connection

The patient's foot is placed on the footplate with the heel near the hinged end. The foot strap, which is attached to an anchor buckle, on one end, is placed over the dorsum of the patient's foot and threaded through an anchor buckle on the opposite side of the footplate. The foot strap section that is lying across the dorsum of the patient's foot is adjusted so that the top edge is at, or slightly below, of the head of the talus. The patient's foot may need to be moved forward or backward to ensure that the top of the strap is positioned properly and that the strap lays flat, in full contact, on the dorsum of the foot. The loose end of the foot strap is pulled tight, through the slot in the anchor buckle, and folded back over itself to engage the hook and loop connection.

Ankle Mortise Strap Attachment

The padded side of the Ankle Mortise Strap is looped around the back of the patient's ankle with the horizontal centerline approximately at the center of the medial and lateral malleolus of the tibia and fibula, respectively. The remaining spring hook on the force strap that was attached to the force lever hook anchor point is attached to both of the-D-rings at the ends of the Ankle Mortise Strap.

Force Lever Engagement

The lower end of the force lever fits into the center of the front anchor track with the cross pin engaged in the yoke on the end of the anchor track. The slight tension from the Ankle Mortise Strap around the back of the ankle mortise, through the force strap to the hook anchor point, holds the force lever cross pin in the anchor track yoke. No mechanical fasteners hold the force lever cross pin into the anchor track yoke as making this connection would be cumbersome for a patient performing a mobilization without assistance.

Hook Anchor Point Adjustment

The hook anchor point can be raised or lowered on the force lever to achieve an optimum angle of force on the back of the ankle mortise. Typically, the plane of the pull should be horizontal. Depending on the nature of the injury and the patient's progress, the physical therapy practitioner may decide to design a slight upward or downward angle into the pull. The angle is easily adjusted by loosening the knob on the hook anchor point collar, sliding the collar up or down, to the desired point, and re-tightening the knob. Graduated marks are engraved into the lower portion of the force lever enabling the physical therapy practitioner to note the selected position of the hook anchor point and record that position for future mobilizations on that patient Anchor Track Adjustment Moving the anchor track forward or backward can change the force applied as well as the amount of glide achieved. The two clamping levers are loosened, the anchor track slid to the desired location and, the clamping levers re-tightened. Initially, the top end of the force lever is moved back to a point where the handgrip is nearly touching the standing patient's body. The anchor track is moved until any slack is removed from the Ankle Mortise Strap, force strap and force-lever-cross-pin/anchor-track-yoke connections and secured by tightening the clamping levers. The clamping levers, being spring loaded, can be rotated to a position that will not interfere with the mobilization without loosening the clamping screw. A measuring tape is affixed to the baseplate, adjacent to the anchor track, enabling the physical therapy practitioner to note the selected position of the anchor track and record that position for future mobilizations on that patient Mobilization Mobilization begins by slowing moving the top end of the force lever ventrally away from the patient's body. The patient's foot, including the talus being strapped to the footplate remains stationary while the tibia and fibula glide anteriorly. Allowing the patient to apply the force by operating the force lever ensures that the mobilization remains pain free. As the mobilizations continue, lunges can be commenced slowly and with little depth at first progressing to deeper lunges as lack of pain permits.

Posterior Mobilization General

Posterior mobilizations with the apparatus are performed with the patient in a standing position. The standing position is necessary because the force lever will be engaged in the rear anchor track behind the patient.

Set Up

Typically, posterior mobilizations are performed with the footplate in the horizontal plane (0° dorsiflexion). The physical therapy practitioner or the patient sets the footplate angle by loosening the two clamping levers at the sides of the footplate. The footplate can then be manually lowered to the horizontal position, as indicated on the elevation plates. The two footplate clamping levers are then tightened to lock the footplate in position. The clamping levers, being spring loaded, can be rotated to a position that will not interfere with the mobilization without loosening the clamping screw. They can be gently pulled away from the footplate and rotated to the desired position.

The foot strap is not utilized for posterior mobilization It can either be folded to the outside of the footplate or removed from the anchor buckle by disengaging its' hook and loop connection.

Force Strap Selection

A single, elastic strap is supplied for the lightest force and least chance of shock loading applied to the ankle joint. Additionally, a tandem elastic strap is supplied for increased force, also with reduced risk of shock loading. Finally, a solid strap is supplied for maximum force and posterior glide of the mortise on the talus. This solid strap is used for patients whose progress is advanced and pain is infinitesimal or not present.

Force Strap Connection

Each of the straps is fitted with a spring snap at each end. The selected strap's spring snap is connected to the hook anchor point on the force lever. The spring snap at the opposite end of the force strap is attached to the D-rings of the Ankle Mortise Strap in a subsequent step.

Heel Cup Installation

The supplied heel cup strap is fitted with an anchor pin at each end and a two-piece stirrup strap. The heel cup strap is installed by placing the anchor pins in the receiver sockets located immediately forward of the elevation plates. The looped portion of the strap, containing the stirrup strap, extends rearward, toward the hinged end of the footplate.

Foot Placement and Connection

The patient's foot is placed into the heel cup, on top of the footplate, with the heel slid firmly back into the padded loop of the heel cup. With the patient's heel, now standing on the stirrup strap assembly, the physical therapy practitioner, or the patient, can adjust the position of the padded section of the heel cup strap. The horizontal centerline of the strap should coincide with the horizontal centerline of the patient's calcaneous. The hook and loop connection between the two parts of the stirrup strap can be repositioned to enable proper placement of the strap around the heel. Hook and loop connections between stirrup strap halves and the heel cup strap can also be used for adjustment and positioning.

Ankle Mortise Strap Attachment

The padded side of the Ankle Mortise Strap is looped around the front of the patient's ankle with the horizontal centerline approximately at the center of the medial and lateral malleolus of the tibia and fibula, respectively The remaining spring hook on the force strap that was attached to the force lever hook anchor point is attached to both of the D-rings at the ends of the Ankle Mortise Strap.

Force Lever Engagement

The lower end of the force lever fits into the center of the rear anchor track with the cross pin engaged in the yoke on the end of the anchor track. The slight tension from the Ankle Mortise Strap around the front of the ankle, through the force strap to the hook anchor point, holds the force lever cross pin in the anchor track yoke.

No mechanical fasteners hold the force lever cross pin into the anchor track yoke, as making this connection would be cumbersome for a patient performing a mobilization without assistance.

Hook Anchor Point Adjustment

The hook anchor point can be raised or lowered on the force lever to achieve an optimum angle of force on the front of the leg/ankle. Typically, the plane of the pull should be horizontal. Depending on the nature of the injury and the patient's progress, the physical therapy practitioner may decide to design a slight upward or downward angle into the pull. The angle is easily adjusted by loosening the knob on the hook anchor point collar, sliding the collar up or down, to the desired point, and re-tightening the knob. Graduated marks are engraved into the lower portion of the force lever enabling the physical therapy practitioner to note the selected position of the hook anchor point and record that position for future mobilizations on that patient.

Anchor Track Adjustment

Moving the anchor track forward or backward can change the force applied as well as the amount of glide achieved. The two clamping levers are loosened, the anchor track slid to the desired location and, the clamping levers re-tightened. Initially, the top end of the force lever is moved back to a point where the handgrip is nearly touching the standing patient's body. The anchor track is moved until any slack is removed from the Ankle Mortise Strap, force strap and force lever cross pin/anchor track yoke connections and secured by tightening the clamping levers. The clamping levers, being spring loaded, can be rotated to a position that will not interfere with the mobilization without loosening the clamping screw. A measuring tape is affixed to the baseplate, adjacent to the anchor track, enabling the physical therapy practitioner to note the selected position of the anchor track and record that position for future mobilizations on that patient Mobilization Mobilization begins by slowing moving the top end of the force lever dorsally away from the patient's body. The patient's foot, including the talus and calcaneous being captive in the heel cup, remains stationary while the tibia and fibula glide posteriorly. Allowing the patient to apply the force by operating the force lever ensures that the mobilization remains pain free.

Epilogue

The apparatus allows for repeatability of ankle mobilization from one physical therapy practitioner to the next, one mobilization to the next and, one patient to the next.

By securing the foot on the footplate and using a lever or other prime mover to apply the force to the lower leg, repeatable mobilizations can be performed regardless of physical therapy practitioner stature, strength or, differences in facilities. Indicia incorporated into the pivot angle, footplate elevation angle, force lever hook anchor point travel and, variable tensile value elastic straps enable quantifiable force and travel (movement). All of these variables can be recorded by the physical therapy practitioner enabling duplication at the next session as well as patient progress tracking.

The apparatus allows mobilizations on a patient in the seated or standing position, with the standing position preferred as it allows for increased dorsiflexion range of motion in the functional closed chain position. In the standing position, movement of the joint can easily be achieved by having the patient perform a forward lunge while the passive mobilization is performed, increasing active dorsiflexion range of motion. Further dorsiflexion can be achieved by elevating the front of the footplate. The footplate can be elevated to, and locked at, any angle to a maximum of 15° above horizontal.

The position of the force lever allows the patient to apply force, and the resulting glide, to him or herself. This enables maximum force and glide without pain as the patient judges the pain intensity for him or herself eliminating the possibility of increased and prolonged pain and delayed recuperation. The physical therapy practitioner can more closely observe and monitor movement and glide while the patient continues the mobilization procedure.

After several supervised mobilization sessions, the physical therapy practitioner can specify the apparatus settings for the next session and the patient can be easily taught to perform the mobilizations unassisted. This allows a patient to take an apparatus home and perform mobilizations on him or herself. This daily mobilization regimen speeds recovery and alleviates pain on days without physical therapy appointments. The apparatus is small and light enough to be easily transported by the patient.

The invention claimed is:

1. An apparatus comprising:

means for securing a foot in said apparatus;

means for attaching a force strap to ends of an ankle mortise strap looped around the mortise of an ankle of the foot; and, means for achieving anterior mobilization by moving said force strap ventrally from the foot so that the foot including the talus remains stationary while the tibia and fibula glide anteriorly;

means for attaching a force strap to ends of an ankle mortise strap looped around the front of an ankle of said foot; means for achieving posterior mobilization by moving said force strap dorsally from said foot so that said foot including the talus remains stationary while the tibia and fibula glide posteriorly;

said means for securing a foot in said apparatus includes a footplate hinged by a hinge at one end; said footplate employing an elevation device at an opposite end allowing said opposite end to be raised to and locked at a degree of dorsiflexion.

2. The apparatus of claim 1 wherein said elevation device is marked to indicate the dorsiflexion angle.

3. The apparatus of claim 1 wherein said elevation device allows said opposite end to be raised to and locked at a maximum degree of dorsiflexion of fifteen degrees (15°) above horizontal.

4. The apparatus of claim 3 wherein locking is achieved through the use of integral adjustable clamping levers.

5. The apparatus of claim 1 wherein adjustment of the length and corresponding tightness of said strap is accomplished with hook and loop material affixed to said strap.

6. The apparatus of claim 1 further including front and rear anchor tracks, said anchor tracks being adjustable fore and all and lockable in desired locations.

7. The apparatus of claim 6 wherein a front measuring tape is located alongside said front anchor track and a rear measuring tape is located alongside said rear anchor track.

8. An apparatus comprising:

a footplate 4;

a front anchor track 12 and a rear anchor track 2, lengthwise centerlines of said anchor tracks 2,12 being coincidental with lengthwise centerlines of said footplate 4 and said baseplate 1;

said footplate including an adjustable, pivoting foot strap 7*a*, said foot strap being secured to said footplate by one or more pivoting strap anchors 7;

a force lever 13;

a front yoke, 12*a* at a far end of said front anchor track constructed to accept said force lever 13; and, a rear yoke 2*a* at a far end of said rear anchor track constructed to accept said force lever; said footplate is hinged by a hinge at one end and employs an elevation device at an opposite end allowing said opposite end to be raised to and locked at a degree of dorsiflexion.

9. The apparatus of claim 8 wherein said elevation device is marked to indicate a dorsiflexion angle.

10. The apparatus of claim 8 wherein said elevation device 5 allows said opposite end to be raised to and locked at up to fifteen degrees (15°) above horizontal.

11. The apparatus of claim 8 wherein locking is achieved through the use of integral adjustable clamping levers 6.

12. The apparatus of claim 8 wherein adjustment of the length and corresponding tightness of said strap 7*a* is accomplished with hook and loop material 23 affixed to said strap 7*a*.

13. The apparatus of claim 8 wherein said anchor tracks 2, 12 are each adjustable fore and aft and are locked in their desired locations with adjustable front clamping levers 11 and rear clamping levers 3.

14. The apparatus of claim 8 wherein a front measuring tape 9 is located alongside said front anchor track and a rear measuring tape 9 is located alongside said rear anchor track.

15. An apparatus comprising:

a baseplate 1;

a footplate 4 attached to said baseplate 1;

a front anchor track 12 and a rear anchor track 2, lengthwise centerlines of said anchor tracks 2,12 being coincidental with lengthwise centerlines of said footplate 4 and said baseplate 1;

said footplate including an adjustable, pivoting foot strap 7*a*, said foot strap being secured to said footplate by two pivoting strap anchors 7;

a force lever 13;

a front yoke, 12*a* at a far end of said front anchor track constructed to accept said force lever 13; and, a rear yoke 2*a* at a far end of said rear anchor track constructed to accept said force lever; said footplate is hinged by a hinge at one end and employs an elevation device ot an opposite end allowing said opposite end to be raised to and locked at a degree of dorsiflexion.

16. The apparatus of claim 15, wherein said elevation device is marked to indicate the dorsiflexion angle.

* * * * *